US007379853B2

(12) United States Patent
Middya

(10) Patent No.: US 7,379,853 B2
(45) Date of Patent: May 27, 2008

(54) METHOD FOR ENHANCING PRODUCTION ALLOCATION IN AN INTEGRATED RESERVOIR AND SURFACE FLOW SYSTEM

(75) Inventor: Usuf Middya, Houston, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 998 days.

(21) Appl. No.: 10/126,215

(22) Filed: Apr. 19, 2002

(65) Prior Publication Data

US 2002/0165671 A1 Nov. 7, 2002

Related U.S. Application Data

(60) Provisional application No. 60/286,134, filed on Apr. 24, 2001.

(51) Int. Cl.
*G06G 7/48* (2006.01)

(52) U.S. Cl. ..... 703/10; 703/2; 702/13

(58) Field of Classification Search ..... 703/2, 703/10; 702/6, 9, 12, 13; 166/245; 700/28
See application file for complete search history.

(56) References Cited

U.S. PATENT DOCUMENTS

| | | | | |
|---|---|---|---|---|
| 5,305,209 | A | 4/1994 | Stein et al. | 702/13 |
| 5,881,811 | A | 3/1999 | Lessi et al. | 166/245 |
| 5,992,519 | A | 11/1999 | Ramakrishnan et al. | 166/250.15 |
| 6,101,447 | A | 8/2000 | Poe, Jr. | 702/13 |
| 6,112,126 | A | 8/2000 | Hales et al. | 700/29 |
| 6,236,894 | B1 | 5/2001 | Stoisits et al. | 700/28 |
| 6,266,619 | B1 | 7/2001 | Thomas et al. | 702/13 |
| 6,356,844 | B2 | 3/2002 | Thomas et al. | 702/12 |
| 2002/0177955 | A1 * | 11/2002 | Jalali et al. | 702/9 |
| 2005/0267718 | A1 | 12/2005 | Guyaguler et al. | |

FOREIGN PATENT DOCUMENTS

| | | |
|---|---|---|
| WO | WO 01/40937 | 6/2001 |
| WO | WO 02/063130 | 8/2002 |
| WO | WO2007/058662 | 5/2007 |

OTHER PUBLICATIONS

Hepguler, G., Barua, S., and Bard, W. A., "Integration of a Field Surface & Production Network with a Reservoir Simulator", SPE Reservoir Simulation Symposium, Jun. 1997, pp. 1-8.
Heinemann, R. F. et al., "Next generation reservoir optimization", *World Oil*, Jan. 1998, pp. 47-54.

(Continued)

*Primary Examiner*—Russell Frejd

(57) ABSTRACT

A method for enhancing allocation of fluid flow rates among a plurality of wellbores coupled to surface facilities is disclosed. The method includes modeling fluid flow characteristics of the wellbores and reservoirs penetrated by the wellbores. The method includes modeling fluid flow characteristics of the surface facilities. An optimizer adapted to determine an enhanced value of an objective function corresponding to the modeled fluid flow characteristics of the wellbores and the surface facilities is then operated. The objective function relates to at least one production system performance parameter. Fluid flow rates are then allocated according to the optimization.

63 Claims, 2 Drawing Sheets

OTHER PUBLICATIONS

Lo, K. K. et al., "Application of Linear Programming to Reservoir Development Evaluations", SPE Reservoir Engineering Symposium, Feb. 1995, pp. 52-58.
European Search Report for corresponding European Patent Application No. 02728833, dated Apr. 23, 2004, 2 pages.
Trick, M. D., "A Different Approach to Coupling a Reservoir Simulator with a Surface Facilities Model", SPE 40001, 1998 SPE Gas Technology Symposium, Calgary Alberta, Canada, Mar. 15-18, 1998, pp. 285-290.
Zhuang, X. and Zbu, J., "Parallelizing a Reservoir Simulator Using MPI", XP002937117, IEEE, 1995, pp. 165-174.
Nikravesh, M., et al., "Nonlinear Control of an Oil Well", Proceedings of the American Control Conference, Albuquerque, New Mexico, Jun. 1997, pp. 739-743.
Hepguler, G.G., et al. "Applications of a Field Surface and Production Network Simulator Integrated with a Reservoir Simulator", Society of Petroleum Engineers, No. 38007, pp. 285-286, 1997.
Liu, W., et al. "Optimal Control of Steamflooding", Society of Petroleum Engineers, No. 21619, pp. 1-46, 1990.
Lyons, S.L. et al., "Integrated Management of Multiple Reservoir Field Developments", Society of Petroleum Engineers, No. 29279, pp. 1-11., 1995.
Palke, M.R., et al., "Nonlinear Optimization of Well Production Considering Gas Lift and Phase Behavior", Society of Petroleum Engineers, No. 37428, pp. 341-456, 1997.
Zakirov, I.S., et al., "Optimizing Reservoir Performance by Automatic Allocation of Well Rates", 5th European Conference on the Mathematics of Oil Recovery, pp. 375-384, 1996.
Barroux, C. C. et al. (2000) "Linking Reservoir and Surface Simulators: How to Improve the Coupled Solutions," *Society of Petroleum Eng.*, SPE 65159, 14 pages.
Beamer, A. et al. (1998) "From Pore to Pipeline, Field-Scale Solutions," *Oilfield Review*, pp. 2-19.
Beliakova, N. et al. (2000) "Hydrocarbon Field Planning Tool for Medium to Long Term Production Forecasting from Oil and Gas Fields Using Integrated Subsurface-Surface Models," *Society of Petroleum Eng.*, SPE 65160, pp. 1-5.
Brown, K. E. et al. (1985) "Nodal Systems Analysis of Oil and Gas Wells," *Society of Petroleum Eng.*, SPE 14714, pp. 1751-1763.
Haugen, E. D. et al. (1995) "Simulation of Independent Reservoirs Coupled by Global Production and Injection Constraints," *Society of Petroleum Eng.*, SPE 29106, pp. 111-123.
Hepguler, G. et al. (1997) "Applications of a Field Surface and Production Network With a Reservoir Simulator," *Society of Petroleum Eng.*, SPE 38007, pp. 285-286.
Holst, R. et al. (1999) "Computer Optimization of Large Gas Reservoirs with Complex Gathering Systems," *Society of Petroleum Eng.*, SPE 56548, 8 pages.
Lamey, M. F. et al. (1999) "Dynamic Simulation of the Europa and Mars Expansion Projects: A New Approach to Coupled Subsea and Topsides Modeling,"*Society of Petroleum Eng.*, SPE 56704, pp. 9 pages.
Litvak, M. L. et al. (1997) "Integration of Prudhoe Bay Surface Pipeline Network and Full Field Reservoir Models," *Society of Petroleum Eng.*, SPE 38885, pp. 435-443.
Northrup, E. J. et al. (1988) "Application and Preconditioned Conjugate-Gradient-Like Methods in Reservoir Simulation," *Society of Petroleum Engineering*, Feb. 1988, pp. 295-301.
Palke, M. R. (1996) "Nonlinear Optimization of Well Production Considering Gas Lift and Phase Behavior," *Report to Dept. of Petroleum Eng. of Stanford University*, 135 pgs.
Palke, M. R. et al. (1997) "Determining the Value of Reservoir Data by Using Nonlinear Production Optimization," *Society of Petroleum Eng.*, SPE 38047, pp. 291-302.
Tingas, J. et al. (1998) "Integrated Reservoir and Surface Network Simulation in Reservoir Management of Southern North Sea Gas Reservoirs," *Society of Petroleum Eng.*, SPE 50635, pp. 51-62.
Venkataraman, R. et al. (2000) "Application of *PIPESIM*-FPT Link to Eclipse 100 to Evaluate Field Development Options," *Offshore Technology Conference*, OTC 11966, 9 pages.
Wade, K. et al. (1999) "Applying New Technology for Field Planning & Production Optimisation," The 1999 Gas Processing Symposium, Apr. 1999, Dubai, UAE, 13 pages.
Weisenborn, A. J. et al. (2000) "Compositional Integrated Subsurface-Surface Modeling," *Society of Petroleum Eng.*, SPE 65158, pp. 12 pages.
Zakirov, I. S. et al. (1996) "Optimizing Reservoir Performance by Automatic Allocation of Well Rates," 5th European Conf. on the Mathematics of Oil Recovery, Leoben, Austria, Sep. 1996, 10 pages.
Hepguler, g., Barua, S., and Bard, W., "Integration of a Field surface and Production Network with a Reservoir Simulator," SPE Computer Applications, Jun. 1997, pp. 88-93.
Opposition dated Aug. 30, 2006 to EPO patent 1389259 based on EP application 02728833.1 in the name of ExxonMobil Upstream Research Company.
Fang et al. "A Generalized Well-Management Scheme for Reservoir Simulation," Society of Petroleum Engineers, SPE Reservoir Engineering, May 1996, pp. 116-120.
Janoski et al. "Advanced Reservoir Simulation Using Soft Computing," Springer-Verlang, 2000, IEA/AIE 2000, LNAI 1821, pp. 623-628.
Aronofsky et al. "The Use of Linear Programming and Mathematical Models in Underground Oil Production," Management Science, Jul. 1962, vol. 8, No. 4, p. 394+ (15 pages).
Valvatne et al. "Semi-Analytical Modeling of the Performance of Intelligent Well Completions," SPE Reservoir Simulation Symposium, Feb. 11-14, 2001, SPE 66368, p. 1-10.
Nikravesh et al. "Mining and fusion of petroleum data with fuzzy logic and neural network agents," Journal of Petroleum Science and Engineering, vol. 29, 2001, pp. 221-238.
Nikravesh et al. "Soft computing: tools for intelligent reservoir characterization (IRESC) and optimum well placement (OWP)," Journal of Petroleum Science and Engineering, vol. 29, 2001, pp. 239-262.
Rardin, R.L., "Optimization in Operations Research," 1998, pp. 389-400.
Economides, M.J.et al., Petroleum Production Systems, Prentice-Hall, 1994, pp. 94-96.

* cited by examiner

METHOD FOR ENHANCING PRODUCTION ALLOCATION IN AN INTEGRATED RESERVOIR AND SURFACE FLOW SYSTEM

CROSS-REFERENCE TO RELATED APPLICATION

This application claims priority benefit from U.S. provisional patent application No. 60/286,134 filed Apr. 24, 2001.

FIELD OF THE INVENTION

The invention relates generally to the field of petroleum production equipment and production control systems. More specifically, the invention relates to methods and systems for controlling production from a plurality of petroleum wells and reservoirs coupled to a limited number of surface facilities so as to enhance use of the facilities and production from the reservoirs.

BACKGROUND OF THE INVENTION

Petroleum is generally produced by drilling wellbores through permeable earth formations having petroleum reservoirs therein, and causing petroleum fluids in the reservoir to move to the earth's surface through the wellbores. Movement is accomplished by creating a pressure difference between the reservoir and the wellbore. Produced fluids from the wells may include various quantities of crude oil, natural gas and/or water, depending on the conditions in the particular reservoir being produced. Depending on conditions in the particular reservoir, the amounts and rates at which the various fluids will be extracted from a particular well depend on factors which include pressure difference between the reservoir and the wellbore. As is known in the art, wellbore pressure may be adjusted by operating various devices such as chokes (orifices) disposed in the fluid flow path along the wellbore, pumps, compressors, fluid injection devices (which pump fluid into a reservoir to increase its pressure). Generally speaking, changing the rate at which a total volume of fluid is extracted from any particular wellbore may also affect relative rates at which oil, water and gas are produced from each wellbore.

Production processing equipment, known by a general term "surface facilities", includes various devices to separate oil and water in liquid form from gas in the produced petroleum. Extracted liquids may be temporarily stored or may be moved to a pipeline for transportation away from the location of the wellbore. Gas may be transported by pipeline to a point of sale, or may be transported by pipe for further processing away from the location of the wellbore. The surface facilities are typically designed to process selected volumes or quantities of produced petroleum. The selected volumes depend on what is believed to be likely volumes of production from various wellbores, and how many wellbores are to be coupled to a particular set of surface facilities. Depending on the physical location of the reservoir, such as below the ocean floor or other remote location, it is often economically advantageous to couple a substantial number of wells, and typically from a plurality of different reservoirs, to a single set of surface facilities. As for less complicated installations, the surface facilities coupled to multiple wells and reservoirs are typically selected to most efficiently process expected quantities of the various fluids produced from the wells. An important aspect of the economic performance of surface facilities is appropriate selection of sizes and capacities of various components of the surface facilities. Equipment which is too small for actual quantities of fluids produced may limit the rate at which the various wellbores may be produced. Such condition may result in poor economic performance of the entire reservoir and surface facility combination. Conversely, equipment which has excess capacity may increase capital costs beyond those necessary, reducing overall rate of return on investment. Still another problem in the efficient use of surface facilities can arise when some wellbores change fluid production rates. As is known in the art, such changes in rate may result from natural depletion of the reservoir, and from unforeseen problems with one or more wellbores in a reservoir, among others. Sometimes, it is possible to change production rates in other wellbores coupled to the surface facilities to maintain throughput in the surface facilities. As is known in the art, however, such production rate changes may be accompanied by changes in relative quantities of water, oil and gas produced from the affected wellbores. Such relative rate changes may affect the ability of the surface facilities to operate efficiently.

One way to determine expected quantities of produced fluids from each wellbore in each reservoir is to mathematically simulate the performance of each well in each reservoir to be coupled to the surface facilities. Typically this mathematical simulation is performed using a computer program. Such reservoir simulation computer programs are well known in the art. Reservoir simulation programs, however, typically do not include any means to couple the simulation result to a simulation of the operation of surface facilities. Therefore, there is no direct linkage between selective operation of the various wellbores and whether the surface facilities are being operated in an optimal way.

One system that attempts to couple reservoir simulation with surface facility simulation is described in, G. G. Hepguler et al, *Integration of a field surface and production network with a reservoir simulator*, SPE Computer Appl. vol. 9, p. 88, Society of Petroleum Engineers, Richardson, Tex. (1997). A limitation to the system described in the Hepguler et al reference is that it is unable to generate a corrective action with respect to the surface facilities which may arise out of infeasibility. Infeasibility is defined as the production system operating outside a constraint or limit, for example, defining a maximum allowable water production which is lower than an expected water production from reservoir simulation. Another limitation in the Hepulger et al system is that there is poor convergence in an optimization routine in the system. Other prior art optimization systems are described, for example in M. R. Palke et al, *Nonlinear optimization of well production considering gas lift and phase behavior*, Proceedings, SPE production operations symposium, p. 341, Society of Petroleum Engineers, Richardson, Tex. (1995). This reference deals primarily with optimizing gas lift systems and does not describe any means for optimizing surface facility use in conjunction with optimizing reservoir production.

A method for optimizing production allocation between wellbores in a reservoir is described in, Zakirov et al, *Optmizing reservoir performance by automatic allocation of well rates*, Conference Proceedings, 5th Math of Oil Recovery, Europe, p. 375 (1996). The method described in this reference does not deal with optimizing the use of surface facilities in conjunction with optimizing reservoir production.

It is desirable to have a simulation system that can enhance or optimize, both reservoir production and surface facility operation simultaneously, while also being able to assist in isolating and rectifying causes of the production system operating outside constraints.

SUMMARY OF THE INVENTION

The invention generally is a method for enhancing allocation of fluid flow rates among a plurality of wellbores coupled to surface facilities. The method includes modeling fluid flow characteristics of the wellbores and reservoirs penetrated by the wellbores. The method includes modeling fluid flow characteristics of the surface facilities. An optimizer adapted to determine an optimal value of an objective function corresponding to the modeled fluid flow characteristics of the wellbores and the surface facilities is then operated. The objective function relates to at least one production system performance parameter. Fluid flow rates are then allocated among the plurality of wellbores as determined by the operating the optimizer.

In some embodiments, a constraint on the system is adjusted. The optimizer is again operated using the adjusted constraint. This is repeated until an enhanced fluid flow rate allocation is determined.

In some embodiments, non-convergence of the optimizer is determined. At least one system constraint is adjusted and the optimizer is again operated. This is repeated until the optimizer converges.

In some embodiments, the optimizer includes successive quadratic programming. A value of a Lagrange multiplier associated with at least one system constraint is determined as a result of the successive quadratic programming. The value of the Lagrange multiplier can be used to determine a sensitivity of the production system to the at least one constraint.

Other aspects and advantages of the invention will be apparent from the following description and the appended claims.

DETAILED DESCRIPTION

Figure 1:
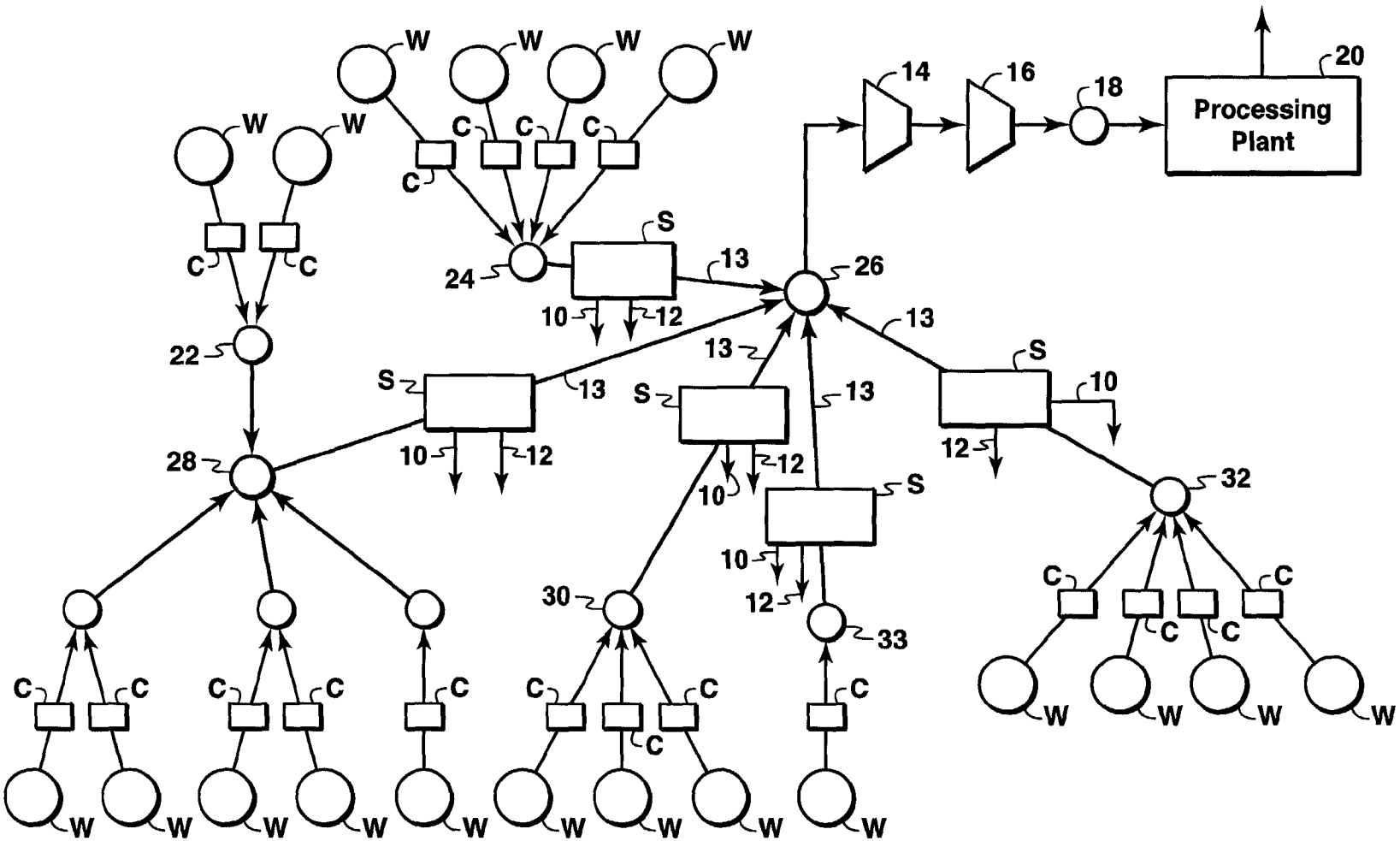
FIG. 1 shows an example of a plurality of wellbores coupled to various surface facilities.

FIG. 1 shows one example of a petroleum production system. The production system in FIG. 1 includes a plurality of wellbores W, which may penetrate the same reservoir, or a plurality of different subsurface petroleum reservoirs (not shown). The wellbores W are coupled in any manner known in the art to various surface facilities. Each wellbore W may be coupled to the various surface facilities using a flow control device C, such as a controllable choke, or similar fixed or variable flow restriction, in the fluid coupling between each wellbore W and the surface facilities. The flow control device C may be locally or remotely operable.

The surface facilities may include, for example, production gathering platforms 22, 24, 26, 28, 30, 32 and 33, where production from one or more of the wellbores W may be collected, stored, commingled and/or remotely controlled. Control in this context means having a fluid flow rate from each wellbore W selectively adjusted or stopped. Fluid produced from each of the wellbores W is coupled directly, or commingled with produced fluids from selected other ones of the wellbores W, to petroleum fluid processing devices which may include separators S. The separators S may be of any type known in the art, and are generally used to separate gas, oil and sediment and water from the fluid extracted from the wellbores W. Each separator S may have a gas output 13, and outputs for liquid oil 10 and for water and sediment 12. The liquid oil 10 and water and sediment 12 outputs may be coupled to storage units or tanks (not shown) disposed on one or more of the platforms 22, 24, 26, 28, 30, 32 and 33, or the liquid outputs 10, 12 may be coupled to a pipeline (not shown) for transportation to a location away from the wellbore W locations or the platforms 22, 24, 26, 28, 30, 32 and 33. The gas outputs 13 may be coupled directly, or commingled at one of the platforms, for example platform 26, to serial-connected compressors 14, 16, then to a terminal 18 for transport to a sales line (not shown) or to a gas processing plant 20, which may itself be on a platform or at a remote physical location. Gas processing plants are known in the art for removing impurities and gas liquids from "separated" gas (gas that is extracted from a device such as one of the separators S). Any one or all of the platforms 22, 24, 26, 28, 30, 32 and 33 may also include control devices (not shown) for regulating the total amount of fluid, including gas, delivered from the respective platform to the separator S, to the pipeline (not shown) or to the compressors 14, 16. It should be clearly noted that the production system shown in FIG. 1 is only an example of the types of production systems and elements thereof than can be used with the method of the invention. The method of the invention only requires that the fluid flow characteristics of each component in any production system be able to be modeled or characterized so as to be representable by an equation or set of equations. "Component" in this context means both the wellbores W and one or more components of the surface facilities. Accordingly, the invention is not intended to be limited to use with a production system that includes or excludes any one or more of the components of the system shown in FIG. 1.

In a production system, such as the one shown in FIG. 1, as some of the wellbores W are operated to extract particular amounts (at selected rates) of fluid from the one or more subsurface reservoirs (not shown), various quantities of gas, oil and/or water will flow into these wellbores W at rates which may be estimated by solution to reservoir mass and momentum balance equations. Such mass and momentum balance equations are well known in the art for estimating wellbore production. The fluid flow rates depend on relative fluid mobilities in the subsurface reservoir and on the pressure difference between the particular one of the wellbores W and the reservoir (not shown). As is known in the art, as any one or more of the wellbores W is selectively controlled, such as by operating its associated flow control device C, the rates at which the various fluids are produced from each such wellbore W will change, both instantaneously and over time. The change over time, as is known in the art, is related to the change in pressure and fluid content distribution in the reservoir as fluids are extracted at known rates. These changes in fluid flow rates may also be calculated using mass and momentum balance equations known in the art. Such changes in fluid flow rates will have an effect on operation of the various components of the surface facilities, including for example, the compressors 14, 16, and the separators S. As will be further explained, a method according to the invention seeks to optimize one or more selected production system performance parameters with respect to both fluid extracted from the one or more subsurface reservoirs (not shown) and with respect to operation of the surface facilities.

It should be noted that in the example production system of FIG. 1, any one or more of the wellbores W may be an injector well, meaning that fluid is not extracted from that wellbore, but that the fluid is pumped into that wellbore. Fluid pumping into a wellbore, as is known in the art, is generally either for disposal of fluid or for providing pressure to the subsurface reservoir (not shown). As a practical matter, the only difference between an injector well (where injection is into one of the reservoirs) and a producing (fluid extracting) wellbore is that for reservoir simulation purposes, an injector well will act as a source of pressure into the reservoir, rather than a pressure sink from the reservoir.

One aspect of the invention is to determine an allocation of fluid flow rates from each of the wellbores W in the production system so that a particular production performance parameter is optimized. The production performance parameter may be, for example, maximization of oil production, minimization of gas and/or water production, or maximizing an economic value of the entire production system, such as by net present value or similar measure of value, or maximizing an ultimate oil or gas recovery from the one or more subsurface reservoirs (not shown). It should be noted that the foregoing are only examples of production performance parameters and that the invention is not limited to the foregoing parameters as the performance parameter which is to be enhanced or optimized.

In a method according to this aspect of the invention, fluid flow allocation is modeled mathematically by a non-linear optimization procedure. The non-linear optimization includes an objective function and a set of inequality and equality constraints. The objective function can be expressed as:

$$F=\Sigma\omega_k\psi_k(\vec{w},\vec{x})$$

The objective function is subject to the following equality constraints represented by the expressions:

$$\vec{H}(\vec{w},\vec{x})=0$$

which represents the subsurface reservoir mass and momentum balance equations and $$\vec{S}(\vec{w},\vec{x})=0$$

which represents the surface facilities flow and pressure balance equations. The objective function is also subject to inequality constraints:

$$\vec{a}\leqq\overline{C}(\overline{w},\overline{x})\leqq\overline{b}$$

where $\overline{w}$ represents subsurface reservoir variables such as fluid component mole number, fluid pressure, temperature, etc. $\overline{x}$ represents "decision" variables such as pressure in any wellbore W at the depth of the subsurface reservoir (known as "bottom hole pressure"—BHP), pressure at any surface "node" (a connection between any two elements of the surface facilities), and $\overline{a}$ and $\overline{b}$ represent lower and upper boundaries for each of the constraints $\overline{C}$. Constraints may include system operating parameters such as gas/oil ratio (GOR), flow rate, pressure, water cut (fractional amount of produced liquid consisting of water), or any similar parameter which is affected by changing the fluid flow rate out of any of the wellbores W, or by changing any operating parameter of any element of the surface facilities, such as separators S or compressors 14, 16.

Variable $\omega_k$ in the above objective function represents a set of weighting factors, which can be applied individually to individual contribution variables, $\psi_k$, in the objective function. The individual contribution variables may include flow rates of the various fluids from each of the wellbores W, although the individual contribution variables are not limited to flow rates. As previously explained, the flow rates can be calculated using well known mass and momentum balance equations. In a method according to this aspect of the invention, any one of the wellbores W or any surface device, including but not limited to the separators S and/or compressors 14, 16 may be represented as one of the reservoir variables or one of the decision variables. Similarly, the objective function can be arranged to include any configuration of wellbores and surface facilities.

The ones of the constraints $\overline{C}$ which represent selected ("target") values of fluid production rates for the system, such as total water flow rate, GOR, or oil flow rate, for example, are preferably inequality constraints with the target values set as an upper or lower boundary, as is consistent with the particular target. Doing this enables the optimizer to converge under conditions where the actual system production rate is different from the target, but does not fall outside the limit set by the target.

An optimization system according to the invention enables production allocation with respect to a production performance parameter that includes reservoir variables in the calculation. Prior art systems that attempt to couple reservoir simulation with surface facility simulation, for example the one described in, G. G. Hepguler et al, *Integration of a field surface and production network with a reservoir simulator*, SPE Computer Appl. vol. 9, p. 88, Society of Petroleum Engineers, Richardson, Tex. (1997) [referred to in the Background section herein], do not seek to optimize production allocation and reservoir calculations in a single executable program. One advantage that may be offered by a system according to the invention is a substantial saving in computation time.

In one embodiment of a method according to the invention, the objective function can be optimized by using successive quadratic programming (SQP). In SQP, the objective function is approximated as a quadratic function, and constraints are linearized. The SQP algorithm used in embodiments of the invention can be described as follows. Consider a general nonlinear optimization problem of the form:

$$\text{Minimize } F(x)\times\in R^n \tag{1}$$

subject to constraints:

$$h_i(x)=0 i=1, \ldots, n_{eq} \tag{2}$$

$$g_j(x)\leqq 0 j=1, \ldots, n_{ieq} \tag{3}$$

If $g_j(x)=0$ then the constraint is active while the constraint is inactive if $g_j(x)<0$. A Lagrange function L(x, u, v) is defined so that:

$$L(x,u,v)\equiv F(x)+\Sigma u_i h_i(x)+\Sigma v_j g_j(x) \tag{4}$$

minimizing L(x, u, v) also minimizes F(x) subject to the above constraints. Here $u_i$ and $v_j$ represent the Lagrange multiplier for equality constraint i and inequality constraint j, respectively. $v_j>0$ for active constraints, while $v_j=0$ when the constraint is inactive. It can be shown that the following conditions are satisfied at the optimum:

$$\nabla L(x,u,v)=\nabla F(x)+\Sigma u_i\nabla h_i(x)+\Sigma v_j\nabla g_j(x)=0 \tag{5}$$

$$u_i h_i(x)=0 \tag{6}$$

$$v_j g_j(x)=0 \tag{7}$$

$$v_j\geqq 0 \tag{8}$$

These conditions are called Karesh-Kuhn-Tucker (KKT) optimality criteria. It can be shown that applying Newton's method to solve the optimality criteria for the problem described in equations (1)–(4) is equivalent to solving the following quadratic problem:

$$\text{Minimize}\nabla F(x_0)\nabla x+\tfrac{1}{2}\Delta x^T H(x_0)\Delta x \quad (9)$$

$$g(x_0)+\nabla g(x_0)\Delta x\leqq 0 \quad (10)$$

$$h(x_0)+\nabla h(x_0)\Delta x=0 \quad (11)$$

where $x_0$ represents the current guess or estimate as to the actual minimum value of the objective function, and $H(x_0)$ represents the Hessian at $x_0$.

Here, as previously explained, the objective function is approximated quadratically while the constraints are linearly approximated. The minimum found for this approximate problem would be exact if the Hessian, $(H(x_0))$, is also exact. However, an inexact Hessian can be used in the foregoing formulation to save computation cost. By applying the above quadratic approximation successively, the real minimum of the objective function is obtained at convergence.

The terms "optimize" and "optimizing" as used with respect to this invention are intended to mean to determine or determining, respectively, an apparent optimum value of the objective function. As will be appreciated by those skilled in the art, in certain circumstances a localized optimum value of the objective function may be determined during any calculation procedure which seeks to determine the true ("global") optimum value of the objective function. Accordingly, the terms "optimize" and "optimizing" are intended to include within their scope any calculation procedure which seeks to determine an enhanced or optimum value of the objective function. Any allocation of fluid flow rates and/or surface facility operating parameters which result from such calculation procedure, whether the global optimum or a localized optimum value of the objective function is actually determined, are therefore also within the scope of this invention. In some instances, as will be readily appreciated by those skilled in the art, it may be desirable for a production system operator to intentionally select a fluid flow rate allocation among the wellbores that is less than optimal as determined by the optimizer. Accordingly, the invention shall not be limited in scope only to determining an optimal fluid flow rate allocation as a result of operating an optimization program according to the various embodiments of the invention.

In a particular embodiment of the invention, the Lagrange multipliers defined in equation (4) can be used to determine a sensitivity of the optimizer to any or all of the optimizer constraints. The values of one or more of the Lagrange multipliers are a measure of the sensitivity of the objective function to the associated constraints. The measure of sensitivity can be used to determine which of the constraints may be relaxed or otherwise adjusted to provide a substantial increase in the value of the system performance parameter that is to be optimized. As an example, a selected maximum total system water production may be a "bottleneck" to total oil production. During optimization, the Lagrange multiplier associated with the maximum total system water production may indicate that a slight relaxation or adjustment of the selected maximum water production rate may provide the production system with the capacity to substantially increase maximum oil production rate, and correspondingly, the economic value (for example, net present value) of the production system. The foregoing is meant to serve only as one example of use of the Lagrange multipliers calculated by the optimizer to determine constraint sensitivity. Any other constraint used in the optimizer may also undergo similar sensitivity analysis to determine production system "bottlenecks".

In one embodiment of a method according to the invention, a so-called "infeasible path" strategy is used, where the initial estimate or guess ($x_0$) is allowed to be infeasible. "Infeasible" means that some or all of the constraints and variables are out of their respective minimum or maximum bounds. For example, one or more of the wellbores W may produce water at a rate which exceeds a maximum water production rate target for the entire system, or the total gas production, as another example, may exceed the capacity of the compressors. The optimization algorithm simultaneously tries to reach to an optimum as well as a feasible solution. Thus feasibility is determined only at convergence. The advantage of this strategy is reduced objective and constraint function evaluation cost. How the infeasible solution strategy of the method of the invention is used will be further explained.

The solution of the optimization problem provides an optimal fluid flow rate and pressure distribution within the entire surface facility network. A part of this solution is then used in the reservoir simulator as the boundary conditions, while then solving the mass and momentum balance equations that describe the fluid flow in the reservoir.

Figure 2:
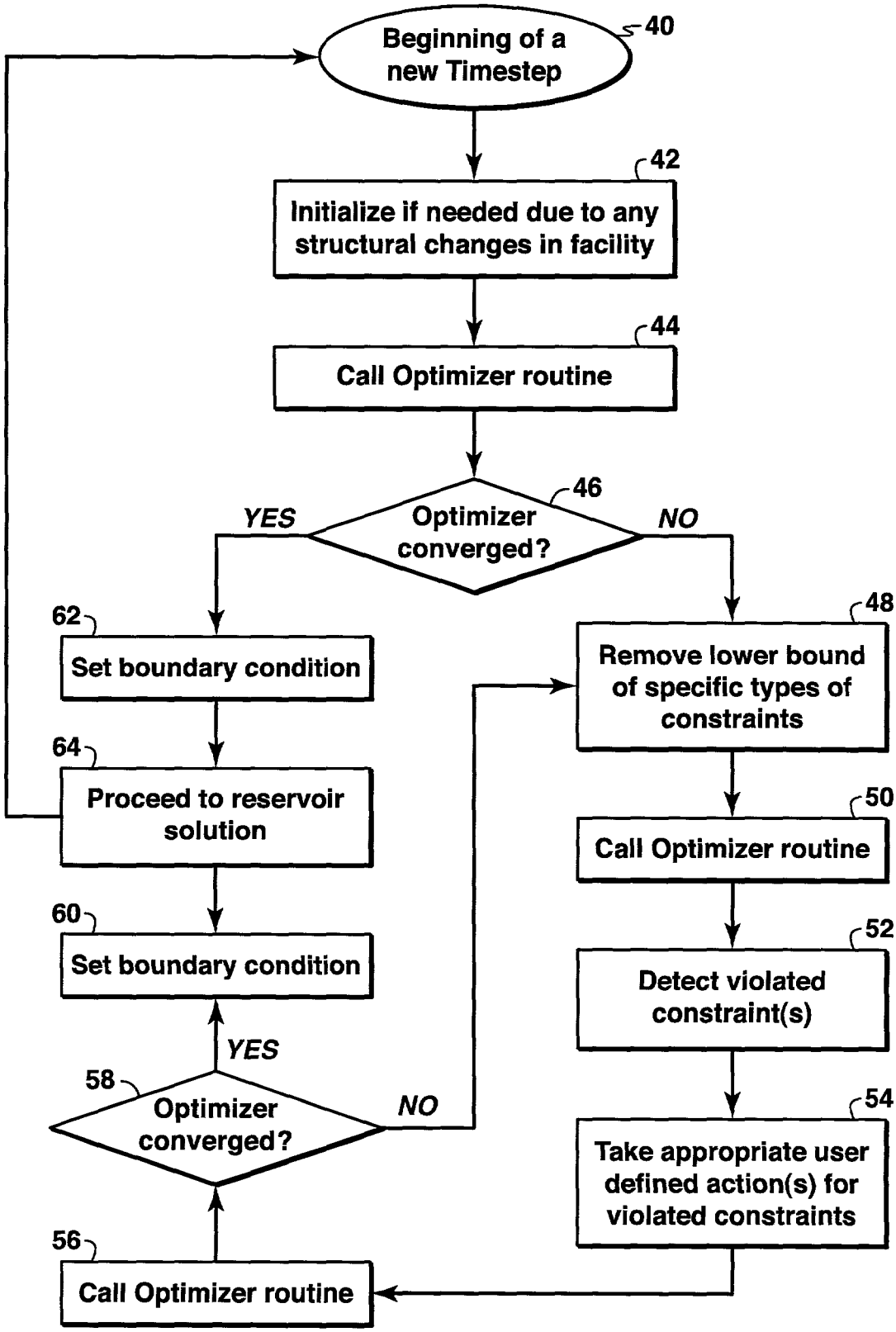
FIG. 2 is a flow chart showing operation of one embodiment of the invention.

A flow chart of how an optimization method according to the invention can be used in operating a production system is shown in FIG. 2. After surface facility equations and reservoir equations are set up, and initial conditions in the surface facility and reservoir are set, at 40 the system time is incremented. If any surface facility operating parameters or structures have been changed from the previous calculation, shown at 42, such changes are entered into the conditions and/or equations for the surface facilities and reservoir. At 44, the conditions and constraints are entered into an optimization routine as previously described. At 46, the optimizer it is determined as to whether the optimizer has reached convergence. As previously explained, when the optimizer reaches convergence, an optimal value of the objective function is determined. When the optimal value of the objective function is determined, the system performance parameter which is represented by the objective function is at an optimal value. As previously explained, the performance parameter can be, for example, economic value, maximum oil production, minimized gas and/or water production, minimum operating cost, or any other parameter related to a measure of production and/or economic performance of the production system such as shown in FIG. 1. The result of the optimization is an allocation of fluid production rates from each of the wellbores (W in FIG. 1) which results in the optimization of the selected system performance parameters.

Referring again to FIG. 2, the output of the optimizer includes fluid production rate allocation among the wellbores in the production system. In actual production and/or injection at the rates allocated by the optimizer, each wellbore (W in FIG. 1) will cause a pressure sink or pressure increase (depending on whether the wellbore is a producing well or injection well) at the reservoir. Such pressure changes propagate through the reservoir, and these pressure changes can be calculated using the mass and momentum balance equations referred to earlier. Therefore, as fluids are produced or injected into each wellbore W, a distribution of conditions in the subsurface reservoir changes. Using the output of the optimizer, the set of fluid flow rates for each wellbore as a set of boundary conditions, as shown at 62, a new distribution of conditions (particularly including but not limited to pressure) for the subsurface reservoir is calculated, at 64.

In some instances, the changes in reservoir conditions will result in changes in fluid flow rates from one or more of the wellbores (W in FIG. 1). As these changes take place, they become part of the initial conditions for operating the optimizer, as indicated in FIG. 2 by a line leading back to box 40.

In other cases, the optimizer will not converge. Failure of convergence, as explained earlier with reference to the description of the SQP aspect of the optimizer, is typically because at least one of the constraints is violated. The constraints may include operating parameters such as maximum acceptable water production in the system, maximum GOR, minimum inlet pressure to the compressor (14 in FIG. 1), and others. In the event no system fluid production allocation will enable meeting all the constraints, the optimizer will not converge. In another aspect of the invention, a cause of the optimizer failing to converge may lead to isolation of one or more elements of the production system which cause the constraints to be violated. At box 48 in FIG. 2, one or more of the constraints may be relaxed or removed. For example a maximum acceptable water production may be increased, or removed as a constraint, or, alternatively, a minimum oil production may be reduced or removed as a constraint. Then, at box 50, the optimizer is run again. If convergence is achieved, then the violated constraint has been identified, at 52. At 54, corrective action can be taken to repair or correct the violated constraint. For example, if a maximum horsepower rating of the compressor (14 in FIG. 1) is exceeded by a selected system gas flow rate, the compressor may be substituted by a higher rating compressor, and the optimizer run again, at 56. Any other physical change to the production system which alters or adjusts a system constraint can be detected and corrected by the method elements outlined in boxes 48, 50, 52 and 54, and the examples referred to herein should not be interpreted as limiting the types of system constraints that can be affected by the method of this invention. At box 58, if the optimizer has converged, then the flow rates are allocated among the wellbores (W in FIG. 1) according to the solution determined by the optimizer. At 60, these fluid flow rates are used as boundary conditions to perform a recalculation of the reservoir conditions, as in the earlier case where the initial run of the optimizer converged (at box 46).

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for enhancing allocation of fluid flow rates among a plurality of wellbores coupled to surface facilities, comprising:

modeling fluid flow characteristics of the wellbores and at least one reservoir penetrated thereby;

modeling fluid flow characteristics of the surface facilities;

operating an optimizer to determine an enhanced value of an objective function, the objective function corresponding simultaneously to the modeled fluid flow characteristics of the wellbores and the surface facilities, the objective function relating to at least one production system performance parameter comprising maximum oil production rate; and allocating fluid flow rates among the plurality of wellbores as determined by operating the optimizer.

2. A method for enhancing allocation of fluid flow rates among a plurality of wellbores coupled to surface facilities, comprising:

modeling fluid flow characteristics of the wellbores and at least one reservoir penetrated thereby;

modeling fluid flow characteristics of the surface facilities;

operating an optimizer to determine an enhanced value of an objective function, the objective function corresponding simultaneously to the modeled fluid flow characteristics of the wellbores and the surface facilities, the objective function relating to at least one production system performance parameter comprising maximum ultimate recovery; and allocating fluid flow rates among the plurality of wellbores as determined by operating the optimizer.

3. A method for enhancing allocation of fluid flow rates among a plurality of wellbores coupled to surface facilities, comprising:

modeling fluid flow characteristics of the wellbores and at least one reservoir penetrated thereby;

modeling fluid flow characteristics of the surface facilities;

operating an optimizer to determine an enhanced value of an objective function, the objective function corresponding simultaneously to the modeled fluid flow characteristics of the wellbores and the surface facilities, the objective function relating to at least one production system performance parameter, wherein the objective function is optimized by successive quadratic programming; and allocating fluid flow rates among the plurality of wellbores as determined by operating the optimizer.

4. A method for enhancing allocation of fluid flow rates among a plurality of wellbores coupled to surface facilities, comprising:

modeling fluid flow characteristics of the wellbores and at least one reservoir penetrated thereby;

modeling fluid flow characteristics of the surface facilities;

operating an optimizer to determine an enhanced value of an objective function, the objective function corresponding simultaneously to the modeled fluid flow characteristics of the wellbores and the surface facilities, the objective function relating to at least one production system performance parameter;

allocating fluid flow rates among the plurality of wellbores as determined by operating the optimizer;

determining non-convergence of the objective function;

adjusting at least one constraint on the objective function;

recalculating the objective function; and repeating the adjusting at least one constraint and recalculating until the objective function converges.

5. The method as defined in claim 4 further comprising:

repeating the determining non-convergence of the objective function;

adjusting at least one element of the surface facilities;

recalculating the objective function; and repeating the adjusting at least one element and recalculating the objective function until the objective function converges.

6. The method as defined in claim 4 wherein the at least one constraint comprises maximum water production rate.

7. The method as defined in claim 4 wherein the at least one constraint comprises maximum gas/oil ratio.

8. The method as defined in claim 4 wherein the at least one constraint comprises maximum water cut.

9. A method for enhancing allocation of fluid flow rates among a plurality of wellbores coupled to surface facilities, comprising:

modeling fluid flow characteristics of the wellbores and at least one reservoir penetrated thereby;

modeling fluid flow characteristics of the surface facilities;

operating an optimizer to determine an enhanced value of an objective function, the objective function corresponding simultaneously to the modeled fluid flow characteristics of the wellbores and the surface facilities, the objective function relating to at least one production system performance parameter;

allocating fluid flow rates among the plurality of wellbores as determined by operating the optimizer;

calculating a fluid pressure distribution in the at least one reservoir after a selected time interval;

recalculating fluid flow rates from the wellbores in response to the fluid pressure distribution calculation; and repeating the operating the optimizer and reallocating fluid flow rates among the wellbores in response to the repeated operating the optimizer.

10. A method for enhancing allocation of fluid flow rates among a plurality of wellbores coupled to surface facilities, comprising:

modeling fluid flow characteristics of the wellbores and at least one reservoir penetrated thereby;

modeling fluid flow characteristics of the surface facilities;

operating an optimizer to determine an enhanced value of an objective function, the objective function corresponding simultaneously to the modeled fluid flow characteristics of the wellbores and the surface facilities, the objective function relating to at least one production system performance parameter; and allocating fluid flow rates among the plurality of wellbores as determined by operating the optimizer;

determining a sensitivity of the objective function to at least one system constraint;

adjusting the at least one constraint and recalculating the objective function using the adjusted constraint; and reallocating fluid flow rates among the plurality of wellbores as determined by the recalculated objective function.

11. The method as defined in claim 10 wherein determining the sensitivity comprises determining an optimal value of the objective function by sequential quadratic approximating, and determining a value of a Lagrange multiplier associated with the at least one constraint.

12. A method for enhancing allocation of fluid flow rates among a plurality of wellbores coupled to surface facilities, comprising:

modeling fluid flow characteristics of the wellbores and at least one reservoir penetrated thereby;

modeling fluid flow characteristics of the surface facilities;

operating an optimizer to determine an enhanced value of an objective function, the objective function corresponding simultaneously to the modeled fluid flow characteristics of the wellbores and the surface facilities, the objective function relating to at least one production system performance parameter, wherein the optimizer comprises at least one constraint corresponding to a target value of at least one system parameter, the optimizer reaching convergence when a value of the at least one constraint is within a range bounded by the target value; and allocating fluid flow rates among the plurality of wellbores as determined by operating the optimizer.

13. The method as defined in claim 12 wherein the at least one system parameter comprises a minimum oil production rate.

14. The method as defined in claim 12 wherein the at least one system parameter comprises a maximum water production rate.

15. A method for enhancing allocation of fluid flow rates among a plurality of wellbores coupled to surface facilities, comprising:

modeling fluid flow characteristics of the wellbores and at least one reservoir penetrated thereby;

modeling fluid flow characteristics of the surface facilities;

operating an optimizer adapted to determine an optimal value of an objective function, the objective function corresponding to the modeled fluid flow characteristics of the wellbores and the surface facilities, the objective function relating to at least one production system performance parameter, the optimizing comprising at least one constraint corresponding to a target value of at least one system operating parameter, the optimizer reaching convergence when a value of the at least one constraint is within a range bounded by the target value; and allocating fluid flow rates among the plurality of wellbores as determined by operating the optimizer.

16. The method as defined in claim 15 wherein the at least one production system performance parameter comprises economic value.

17. The method as defined in claim 15 wherein the at least one production system performance parameter comprises water production rate.

18. The method as defined in claim 15 wherein the at least one production system performance parameter comprises minimum gas/oil ratio.

19. The method as defined in claim 15 wherein the at least one production system performance parameter comprises oil production rate.

20. The method as defined in claim 15 wherein the at least one production system performance parameter comprises ultimate recovery.

21. The method as defined in claim 15 wherein the optimizer comprises successive quadratic programming.

22. The method as defined in claim 15 further comprising:

determining non-convergence of the objective function;

adjusting the value of the at least one constraint;

recalculating the objective function; and repeating the adjusting the value of the at least one constraint and recalculating until the objective function converges.

23. The method as defined in claim 22 further comprising:

repeating the determining non-convergence of the objective function;

adjusting at least one element of the surface facilities;

recalculating the objective function;

repeating the adjusting at least one element and recalculating until the objective function converges.

24. The method as defined in claim 22 wherein the at least one constraint comprises a maximum water production.

25. The method as defined in claim 22 wherein the at least one constraint comprises a maximum gas/oil ratio.

26. The method as defined in claim 22 wherein the at least one constraint comprises a maximum water cut.

27. The method as defined in claim 15 further comprising:

calculating a fluid pressure distribution in the at least one reservoir after a selected time interval;

recalculating fluid flow rates from the wellbores in response to the fluid pressure distribution calculation;

repeating the operating the optimizer; and reallocating fluid flow among the plurality of wellbores in response to the repeated operation of the optimizer.

28. The method as defined in claim 15, further comprising:

determining a sensitivity of the objective function to at least one system operating constraint in a plurality of system operating constraints;

adjusting the at least one system operating constraint and recalculating the objective function using the adjusted system operating constraint; and reallocating fluid flow rates among the plurality of wellbores as determined by the recalculated objective function.

29. The method as defined in claim 28 wherein determining the sensitivity comprises calculating the objective function by sequential quadratic approximating, and determining a value of a Lagrange multiplier associated with the at least one system operating constraint.

30. The method as defined in claim 28 wherein the at least one system operating constraint comprises a maximum water production.

31. The method as defined in claim 28 wherein the at least one system operating constraint comprises a maximum gas/oil ratio.

32. The method as defined in claim 28 wherein the at least one system operating constraint comprises a maximum water cut.

33. A method for enhancing allocation of fluid flow rates among a plurality of wellbores coupled to surface facilities, comprising:

modeling fluid flow characteristics of the wellbores and at least one reservoir penetrated thereby;

modeling fluid flow characteristics of the surface facilities;

optimizing an objective function, the objective function corresponding simultaneously to the modeled fluid flow characteristics of the wellbores and the surface facilities, the objective function relating to at least one production system performance parameter, wherein the at least one production system performance parameter comprises oil production rate; and allocating fluid flow rates among the plurality of wellbores as determined by the optimizing.

34. A method for optimizing allocation of fluid flow rates among a plurality of wellbores coupled to surface facilities, comprising:

modeling fluid flow characteristics of the wellbores and at least one reservoir penetrated thereby;

modeling fluid flow characteristics of the surface facilities;

optimizing an objective function, the objective function corresponding simultaneously to the modeled fluid flow characteristics of the wellbores and the surface facilities, the objective function relating to at least one production system performance parameter, wherein the at least one production system performance parameter comprises ultimate recovery; and allocating fluid flow rates among the plurality of wellbores as determined by the optimizing.

35. A method for optimizing allocation of fluid flow rates among a plurality of wellbores coupled to surface facilities, comprising:

modeling fluid flow characteristics of the wellbores and at least one reservoir penetrated thereby;

modeling fluid flow characteristics of the surface facilities;

optimizing an objective function, the objective function corresponding simultaneously to the modeled fluid flow characteristics of the wellbores and the surface facilities, the objective function relating to at least one production system performance parameter, wherein the at least one production system performance parameter, wherein the objective function is optimized by successive quadratic programming;

allocating fluid flow rates among the plurality of wellbores as determined by the optimizing.

36. A method for optimizing allocation of fluid flow rates among a plurality of wellbores coupled to surface facilities, comprising:

modeling fluid flow characteristics of the wellbores and at least one reservoir penetrated thereby;

modeling fluid flow characteristics of the surface facilities;

optimizing an objective function, the objective function corresponding simultaneously to the modeled fluid flow characteristics of the wellbores and the surface facilities, the objective function relating to at least one production system performance parameter, wherein the at least one production system performance parameter; and allocating fluid flow rates among the plurality of wellbores as determined by the optimizing;

determining non-convergence of the objective function;

adjusting at least one constraint on the objective function;

recalculating the objective function; and repeating the adjusting at least one constraint and recalculating until the objective function converges.

37. The method as defined in claim 36 further comprising:

repeating the determining non-convergence of the objective function;

adjusting at least one element of the surface facilities;

recalculating the objective function; and repeating the adjusting at least one element and recalculating until the objective function converges.

38. The method as defined in claim 36 wherein the at least one constraint comprises water production rate.

39. The method as defined in claim 36 wherein the at least one constraint comprises gas/oil ratio.

40. The method as defined in claim 36 wherein the at least one constraint comprises water cut.

41. A method for optimizing allocation of fluid flow rates among a plurality of wellbores coupled to surface facilities, comprising:

modeling fluid flow characteristics of the wellbores and at least one reservoir penetrated thereby;

modeling fluid flow characteristics of the surface facilities;

optimizing an objective function, the objective function corresponding simultaneously to the modeled fluid flow characteristics of the wellbores and the surface facilities, the objective function relating to at least one production system performance parameter, wherein the at least one production system performance parameter; and allocating fluid flow rates among the plurality of wellbores as determined by the optimizing;

calculating a fluid pressure distribution in the at least one reservoir after a selected time interval;

recalculating fluid flow rates from the wellbores in response to the fluid pressure distribution calculation;

repeating the optimizing the objective function; and reallocating fluid flow among the plurality of wellbores in response to the repeated optimizing.

42. A method for optimizing allocation of fluid flow rates among a plurality of wellbores coupled to surface facilities, comprising:

modeling fluid flow characteristics of the wellbores and at least one reservoir penetrated thereby;

modeling fluid flow characteristics of the surface facilities;

optimizing an objective function, the objective function corresponding simultaneously to the modeled fluid flow characteristics of the wellbores and the surface facilities, the objective function relating to at least one production system performance parameter, wherein the at least one production system performance parameter;

allocating fluid flow rates among the plurality of wellbores as determined by the optimizing;

determining a sensitivity of the objective function to at least one system constraint;

adjusting the at least one constraint and recalculating the objective function using the adjusted constraint; and reallocating fluid flow rates among the plurality of wellbores as determined by the recalculated objective function.

43. The method as defined in claim 42 wherein determining the sensitivity comprises optimizing the objective function by sequential quadratic approximating, and determining a value of a Lagrange multiplier associated with the at least one constraint.

44. A method for optimizing allocation of fluid flow rates among a plurality of wellbores coupled to surface facilities, comprising:

modeling fluid flow characteristics of the wellbores and at least one reservoir penetrated thereby;

modeling fluid flow characteristics of the surface facilities;

optimizing an objective function, the objective function corresponding simultaneously to the modeled fluid flow characteristics of the wellbores and the surface facilities, the objective function relating to at least one production system performance parameter, wherein the at least one production system performance parameter, wherein the optimizing comprises at least one constraint corresponding to a target value of at least one system parameter, the optimizing adapted to converge when a value of the at least one constraint is within a range bounded by the target value.

allocating fluid flow rates among the plurality of wellbores as determined by the optimizing;

45. The method as defined in claim 44 wherein the at least one system parameter comprises a minimum oil production rate.

46. The method as defined in claim 44 wherein the at least one system parameter comprises a maximum water production rate.

47. A method for optimizing allocation of fluid flow among a plurality of wellbores coupled to surface facilities, comprising:

modeling fluid flow characteristics of the wellbores and at least one reservoir penetrated thereby;

modeling fluid flow characteristics of the surface facilities;

optimizing an objective function, the objective function corresponding to the modeled fluid flow characteristics of the wellbores and the surface facilities, the objective function relating to at least one production system performance parameter;

determining a sensitivity of the objective function to at least one system constraint;

adjusting the at least one system constraint and recalculating the objective function using the adjusted system constraint; and reallocating fluid flow rates among the plurality of wellbores as determined by the recalculated objective function; and allocating fluid flow rates among the plurality of wellbores as determined by the optimizing.

48. The method as defined in claim 47 wherein the at least one production system performance parameter comprises economic value.

49. The method as defined in claim 47 wherein the at least one production system performance parameter comprises water production rate.

50. The method as defined in claim 47 wherein the at least one production system performance parameter comprises gas/oil ratio.

51. The method as defined in claim 47 wherein the at least one production system performance parameter comprises oil production rate.

52. The method as defined in claim 47 wherein the at least one production system performance parameter comprises ultimate recovery.

53. The method as defined in claim 47 wherein the objective function is optimized by successive quadratic programming.

54. The method as defined in claim 47 further comprising:

determining non-convergence of the objective function;

adjusting at least one constraint on the objective function;

recalculating the objective function; and repeating the adjusting at least one constraint and recalculating until the objective function converges.

55. The method as defined in claim 54 further comprising:

repeating the determining non-convergence of the objective function;

adjusting at least one element of the surface facilities;

recalculating the objective function;

repeating the adjusting at least one element and recalculating until the objective function converges.

56. The method as defined in claim 54 wherein the at least one constraint comprises water production rate.

57. The method as defined in claim 54 wherein the at least one constraint comprises gas/oil ratio.

58. The method as defined in claim 54 wherein the at least one constraint comprises water cut.

59. The method as defined in claim 47 further comprising:

calculating a fluid pressure distribution in the at least one reservoir after a selected time interval;

recalculating fluid flow rates from the wellbores in response to the fluid pressure distribution calculation;

repeating the optimizing the objective function; and reallocating fluid flow among the plurality of wellbores in response to the repeated optimizing.

60. The method as defined in claim 47 wherein determining the sensitivity comprises optimizing the objective function by sequential quadratic approximating, and determining a value of a Lagrange multiplier associated with the at least one constraint.

61. The method as defined in claim 47 wherein the optimizing comprises at least one constraint corresponding to a target value of at least one system parameter, the optimizing adapted to converge when a value of the at least one constraint corresponding to the target value is within a range bounded by the target value.

62. The method as defined in claim 61 wherein the at least one system parameter comprises an oil production rate.

63. The method as defined in claim 61 wherein the at least one system parameter comprises a water production rate.

* * * * *